US008517483B2

(12) United States Patent
Eubanks et al.

(10) Patent No.: US 8,517,483 B2
(45) Date of Patent: Aug. 27, 2013

(54) MODULAR SYSTEM FOR A DOMESTIC REFRIGERATOR

(75) Inventors: Rebecca M. Eubanks, Stevensville, MI (US); Douglas D. Leclear, Benton Harbor, MI (US); Karen J. Querfurth, Coloma, MI (US); Michele E. Wilcox, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 214 days.

(21) Appl. No.: 12/712,273

(22) Filed: Feb. 25, 2010

(65) Prior Publication Data

US 2011/0204762 A1 Aug. 25, 2011

(51) Int. Cl.
*A47B 96/04* (2006.01)

(52) U.S. Cl.
USPC ..... 312/404

(58) Field of Classification Search
USPC ..... 312/400, 402, 404, 408, 405.1, 321.5, 312/348.3, 308, 31, 31.02, 31.1–31.3, 245; 211/192, 75, 106.01, 87.01; 62/441, 78, 62/187, 465; 220/480, 481, 751; 248/309.1, 248/311.2, 314, 209
See application file for complete search history.

(56) References Cited

U.S. PATENT DOCUMENTS

| | | | | | |
|---|---|---|---|---|---|
| 91,021 | A | * | 6/1869 | Howarth | 62/465 |
| 1,774,312 | A | * | 8/1930 | Braeutigam | 62/382 |
| 1,984,977 | A | * | 12/1934 | Mize | 312/276 |
| 2,067,920 | A | * | 1/1937 | Heuser | 34/80 |
| 2,270,796 | A | * | 1/1942 | Hauser | 211/119.004 |
| 2,284,905 | A | * | 6/1942 | Jackson | 34/72 |
| 2,385,866 | A | * | 10/1945 | Kuchner | 62/372 |
| 2,425,323 | A | * | 8/1947 | Hueber | 101/369 |
| 2,514,902 | A | * | 7/1950 | Sabath | 96/148 |
| 2,557,432 | A | * | 6/1951 | Holstedt | 96/148 |
| 2,579,895 | A | * | 12/1951 | Anderssen | 211/75 |
| 2,613,509 | A | * | 10/1952 | Philipp | 62/287 |
| 2,711,873 | A | * | 6/1955 | Larin | 248/215 |
| 2,765,046 | A | * | 10/1956 | Rondholz | 62/271 |
| 3,477,679 | A | * | 11/1969 | Lovitz | 248/213.2 |
| 4,358,935 | A | * | 11/1982 | Losert et al. | 62/188 |
| 4,751,826 | A | * | 6/1988 | Kawahara et al. | 62/382 |
| 4,844,394 | A | * | 7/1989 | Randolph | 248/205.3 |

(Continued)

FOREIGN PATENT DOCUMENTS

| | | | |
|---|---|---|---|
| CN | 1862182 | A | 11/2006 |
| EP | 1757881 | A2 | 2/2007 |

(Continued)

OTHER PUBLICATIONS

Timestrip Elapsed Time Indicators Monitor, Inform and Protect; Timestrip UK Ltd; 2012, 2 pages.

*Primary Examiner* — Janet M Wilkens
*Assistant Examiner* — Timothy M Ayres
(74) *Attorney, Agent, or Firm* — Kirk W. Goodwin

(57) ABSTRACT

A domestic refrigerator includes a housing having a refrigerated compartment defined therein, and a sliding drawer positioned in the refrigerated compartment. The sliding drawer has a storage chamber defined therein, and a mounting bracket is secured to the sliding drawer and extends into the storage chamber. The domestic refrigerator also includes a plurality of interchangeable utility modules that are configured to be positioned within the storage chamber of the sliding drawer. Each of the plurality of the interchangeable utility modules includes a mounting bracket sized and configured to be separately mated with the mounting bracket of the sliding drawer.

13 Claims, 6 Drawing Sheets

(56) References Cited

U.S. PATENT DOCUMENTS

| | | | | |
|---|---|---|---|---|
| 4,845,958 | A * | 7/1989 | Senda et al. | 62/418 |
| 4,900,346 | A * | 2/1990 | Lutz | 96/142 |
| 4,913,942 | A * | 4/1990 | Jick | 96/121 |
| 4,944,566 | A * | 7/1990 | Carper | 312/311 |
| 4,955,208 | A * | 9/1990 | Kawashima et al. | 62/264 |
| 5,253,488 | A * | 10/1993 | Kim et al. | 62/382 |
| 5,278,112 | A | 1/1994 | Klatte | |
| 5,397,097 | A * | 3/1995 | Dale | 249/121 |
| 5,492,675 | A * | 2/1996 | Brizard | 422/122 |
| 5,772,959 | A * | 6/1998 | Bermas | 422/5 |
| 6,223,553 | B1 * | 5/2001 | Albert et al. | 62/407 |
| 6,346,143 | B1 * | 2/2002 | McGowan | 96/117.5 |
| 6,655,169 | B2 * | 12/2003 | Tupis et al. | 62/417 |
| 6,767,521 | B1 * | 7/2004 | Vogt et al. | 422/306 |
| 6,862,980 | B2 | 3/2005 | Heil et al. | |
| 6,913,733 | B2 * | 7/2005 | Hardy et al. | 422/124 |
| 7,005,000 | B2 | 2/2006 | Stiros et al. | |
| 7,028,503 | B2 | 4/2006 | Lyvers et al. | |
| 7,210,307 | B2 * | 5/2007 | Kuehl et al. | 62/344 |
| 8,157,882 | B2 * | 4/2012 | Curtis et al. | 55/505 |
| 2004/0237544 | A1 * | 12/2004 | Ueno et al. | 62/78 |
| 2005/0183637 | A1 * | 8/2005 | Reeser | 108/26 |
| 2006/0174647 | A1 * | 8/2006 | Kuehl et al. | 62/344 |
| 2007/0065332 | A1 | 3/2007 | Stiros et al. | |
| 2007/0095090 | A1 * | 5/2007 | Kuehl et al. | 62/344 |
| 2007/0272092 | A1 | 11/2007 | Ehrenreich | |
| 2008/0217340 | A1 | 9/2008 | Jager | |
| 2009/0293511 | A1 | 12/2009 | Allard et al. | |

FOREIGN PATENT DOCUMENTS

| | | | |
|---|---|---|---|
| JP | 10-238934 | * | 9/1998 |
| JP | 10238934 | | 9/1998 |
| JP | 11230665 | A | 8/1999 |
| JP | 2000-4783 | * | 1/2000 |
| JP | 2000180034 | A | 6/2000 |
| JP | 2003-148861 | * | 5/2003 |
| JP | 2007093202 | A | 4/2007 |

* cited by examiner

MODULAR SYSTEM FOR A DOMESTIC REFRIGERATOR

TECHNICAL FIELD

The present disclosure relates generally to a domestic refrigerator and more particularly to a modular system for a domestic refrigerator.

BACKGROUND

A domestic refrigerator is a device that is used to store food items in a home. Domestic refrigerators typically include crisper bins, shelves, and other structures in which food items may be placed. Some food items stored in refrigerators may require special care or handling to ensure those food items are preserved for later use.

SUMMARY

According to one aspect, a domestic refrigerator is disclosed. The domestic refrigerator includes a housing having a refrigerated compartment defined therein, and a sliding drawer positioned in the refrigerated compartment. The sliding drawer has a number of sidewalls that define a storage chamber and a mounting bracket extending into the storage chamber. A plurality of interchangeable utility modules are sized to be positioned within the storage chamber of the sliding drawer. Each of the plurality of the interchangeable utility modules includes a mounting bracket sized and configured to be separately mated with the mounting bracket of the sliding drawer.

In some embodiments, the mounting bracket of the sliding drawer may include a pair of mounting arms, and the mounting bracket of each of the plurality of interchangeable utility modules may include a pair of slots sized to receive the pair of mounting arms of the sliding drawer. In some embodiments, the mounting bracket of each of the plurality of interchangeable utility modules may include a pair of mounting arms, and the mounting bracket of the sliding drawer may include a pair of slots sized to separately receive the pair of mounting arms of each of the plurality of interchangeable utility modules.

In some embodiments, one of the plurality of interchangeable utility modules may include a housing having a compartment defined therein. The compartment may be sized to receive a food item. In some embodiments, the domestic refrigerator may include a second mounting bracket extending into the storage chamber of the sliding drawer. The mounting bracket of each of the plurality of the interchangeable utility modules may be sized and configured to be separately mated with the second mounting bracket such that more than one interchangeable utility module of the plurality of interchangeable utility modules may be positioned in the storage chamber concurrently.

In some embodiments, one of the plurality of interchangeable utility modules may include a housing having a vented compartment defined therein. The vented compartment may be sized to receive a sachet containing an ethylene absorbing agent. A cover may be hinged to an upper end of the housing. The cover may be movable between an open position in which user access to the vented compartment is permitted, and a closed position in which user access to the vented compartment is prevented. In some embodiments, the interchangeable utility module may include a removable elapsed time indicator configured to provide an indication of the ethylene absorbing agent. Additionally, in some embodiments, the housing may have a second vented compartment defined therein, and the second vented compartment may be sized to receive a second sachet containing an ethylene absorbing agent.

In some embodiments, the vented compartment may be sized to receive a sachet containing an odor absorbing agent. In some embodiments, one of the plurality of interchangeable utility modules may include a housing having a first compartment and a second compartment defined therein, a first storage tray positioned in the first compartment and sized to receive a first food item, and a second storage tray positioned in the second compartment and sized to receive a second food item.

In some embodiments, one of the plurality of interchangeable utility modules may include a housing having a compartment defined therein, and the compartment may be sized to receive a food item. A cover may hinged to an upper end of the housing, which may be movable between an open position in which user access to the compartment is permitted, and a closed position in which user access to the compartment is prevented. A number of louvered vents may extend through the cover, and each of the number of louvered vents may be operable to regulate air flow into the compartment.

In some embodiments, one of the plurality of interchangeable utility modules may include a rectangular beam having a rear surface configured to receive the mounting bracket of the sliding drawer and a front surface positioned opposite the rear surface. A plurality of mounting elements may be positioned on the front surface of the rectangular beam. In some embodiments, the plurality of mounting elements may include a number of hooks and a number of retaining clips.

In some embodiments, the domestic refrigerator may also include a second sliding drawer positioned in the refrigerated compartment that includes a number of sidewalls. The number of sidewalls may define a second storage chamber. A second mounting bracket may extend into the second storage chamber, and the mounting bracket of each of the plurality of the interchangeable utility modules may be sized and configured to be separately mated with the second mounting bracket.

According to another aspect, a crisper drawer for a domestic refrigerator is disclosed. The crisper drawer includes a number of sidewalls defining a storage chamber, a mounting bracket extending from one of the sidewalls into the storage chamber, a first interchangeable utility module to be positioned within the storage chamber, and a second interchangeable utility module to be positioned within the storage chamber. The first interchangeable utility module includes a pair of sachets, and each sachet contains an absorptive agent. The second interchangeable utility module includes a compartment sized to receive a food item, and a louvered vent operable to regulate humidity in the compartment. Each of the first interchangeable utility module and the second interchangeable utility module includes a mounting bracket sized and configured to be separately mated with the mounting bracket extending from one of the sidewalls.

In some embodiments, the absorptive agent is an odor absorbing agent. In some embodiments, the absorptive agent is an ethylene absorbing agent. Additionally, in some embodiments, the mounting bracket extending from one of the sidewalls may include a pair of mounting arms, and the mounting bracket of each of the first interchangeable utility module and the second interchangeable utility module may include a pair of slots sized to receive the pair of mounting arms. In some embodiments, the mounting bracket of each of first interchangeable utility module and the second interchangeable utility module may include a pair of mounting arms, and the mounting bracket extending from one of the sidewalls may include a pair of slots sized to separately receive the pair of mounting arms of each of the plurality of interchangeable utility modules.

According to another aspect, a domestic refrigerator includes a housing having a refrigerated compartment defined therein, and a sliding drawer positioned in the refrigerated compartment. The sliding drawer has a storage chamber defined therein. A mounting bracket extends into the storage chamber, and a plurality of interchangeable utility modules are positioned within the storage chamber of the sliding drawer. Each of the plurality of the interchangeable utility modules includes a mounting bracket sized and configured to be separately mated with the mounting bracket of the sliding drawer

BRIEF DESCRIPTION OF THE DRAWINGS

The detailed description particularly refers to the following figures, in which.

DETAILED DESCRIPTION OF THE DRAWINGS

Figure 1:
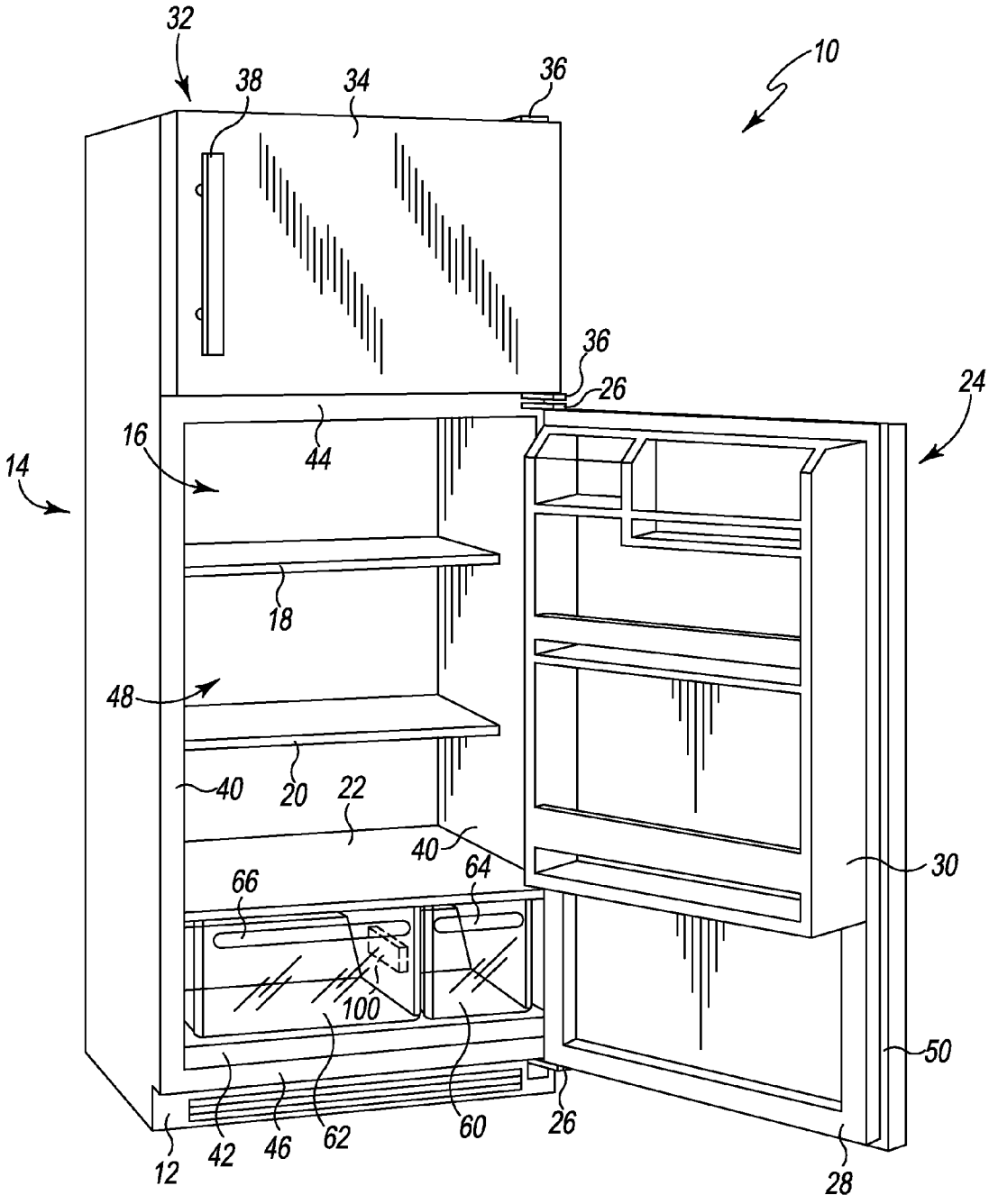
FIG. 1 is a perspective view of a domestic refrigerator.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a domestic refrigerator appliance 10 (hereinafter refrigerator 10). One example of a domestic refrigerator is the Whirlpool Top Mount Refrigerator Model No. W4TXNWFWQ, which is commercially available from Whirlpool Corporation of Benton Harbor, Mich., U.S.A. The refrigerator 10 includes a lower frame 12 and a housing 14 extending upwardly from the lower frame 12. The refrigerator housing 14 defines a refrigerated compartment 16 into which a user may place and store food items such as milk, cheese, produce, etcetera. The refrigerated compartment 16 is operable to maintain stored food items at a predefined temperature. The refrigerator 10 includes an upper shelf 18, a middle shelf 20, and a lower shelf 22 positioned within the refrigerated compartment 16.

A door 24 is hinged to the front of the refrigerator housing 14 via a pair of hinge assemblies 26. The door 24 permits user access to the refrigerated compartment 16 such that food items may be placed in and retrieved from the refrigerator 10. A handle (not shown) is located on a front panel of the door 24, and the user may use the handle to pull the door 24 open. The door 24 also includes a back panel 28, which has a number of shelves 30 extending therefrom that are positioned in the refrigerated compartment 16 when the door 24 is closed.

The refrigerator housing 14 also defines a freezer compartment 32, which is independently operable to maintain food items stored therein at a certain temperature. A door 34 is hinged to the front of the refrigerator housing 14 via a pair of hinge assemblies 36. The door 34 permits user access to the freezer compartment 32 such that food items may be placed in and retrieved from the refrigerator 10. A handle 38 is located on the door 34, and the user may use the handle 38 to pull the door 34 open. The freezer compartment 32 is shown positioned above the refrigerated compartment 16. It will be appreciated that in other embodiments the freezer compartment may be positioned below or side-by-side with the refrigerated compartment 16. It will be further appreciated that in other embodiments the refrigerator 10 may not have a freezer compartment.

The refrigerator housing 14 includes a number of sidewalls 40 that extend upwardly from a bottom wall 42 to a top wall 44, thereby defining the refrigerated compartment 16. The open front side 46 of the refrigerator housing 14 defines an access opening 48, which provides user access to the shelves 18, 20, 22, 30 when the door 24 is open. When the door 24 is closed, an outer edge 50 of the back panel 28 of the door 24 seals the access opening 48, thereby preventing the user from accessing the shelves 18, 20, 22, 30. The door 24 also prevents chilled air from escaping through the access opening 48 of the refrigerator 10.

The refrigerator 10 includes a pair of crisper drawers 60, 62 positioned below the lower shelf 22. The drawers 60, 62 are configured to extend from and retract into the refrigerated compartment 16. The drawers 60, 62 include handles 64, 66, respectively, that permit the user to extend and retract the drawers 60, 62. Each of the drawers 60, 62 is formed from injection molded clear polypropylene. It will be appreciated that in other embodiments the polypropylene may be opaque or colored. It will also be appreciated that the drawers 60, 62 may be formed from other suitable plastics and may include metal assemblies, such as rollers or sliders, that allow the drawers 60, 62 to extend and retract.

Figure 2:
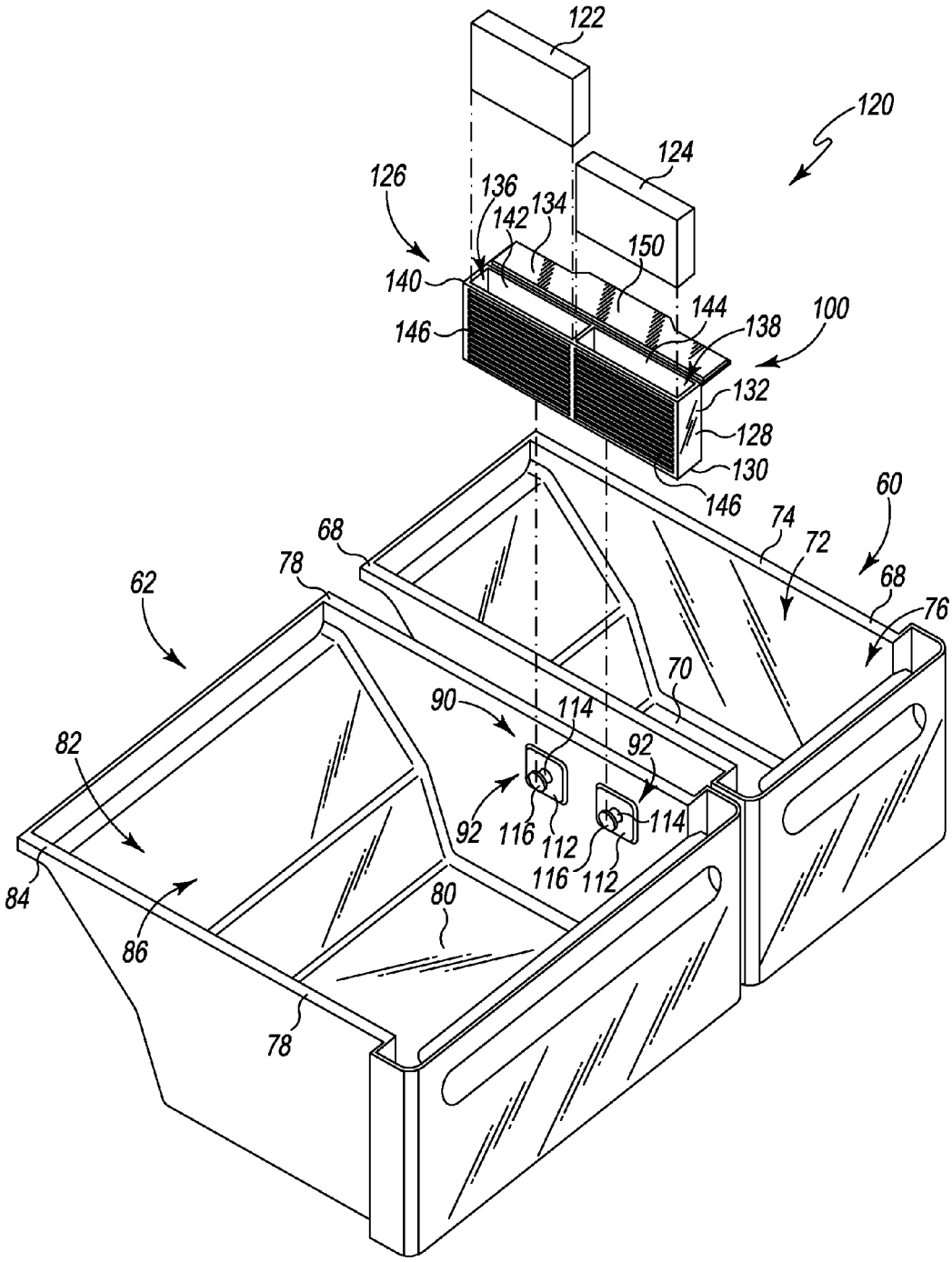
FIG. 2 is a perspective view of one embodiment of a pair of drawers and an interchangeable utility module of the domestic refrigerator of FIG. 1.

Referring now to FIG. 2, the drawer 60 of the refrigerator 10 includes a number of sidewalls 68 that extend upwardly from a bottom wall 70, thereby defining a storage chamber 72 in which the user may place items to be stored. An open top side 74 of the drawer 60 defines an access opening 76, which provides user access to the storage chamber 72 when the drawer 60 is extended from the refrigerated compartment 16.

The drawer 62 similarly includes a number of sidewalls 78 that extend upwardly from a bottom wall 80, thereby defining another storage chamber 82 in which the user may place items to be stored. An open top side 84 of the drawer 62 defines an access opening 86, which provides user access to the storage chamber 82 when the drawer 62 is extended from the refrigerated compartment 16.

The drawer 62 also includes a mounting bracket 90 that extends into the storage chamber 82. The mounting bracket 90, which is illustratively embodied as a pair of mounting arms 92, is formed by injection molding polypropylene. The polypropylene is opaque or colored but in other embodiments the polypropylene may be clear. It will also be appreciated that the bracket 90 may be formed from other suitable plastics or hardened rubber. As shown in FIG. 2, the bracket 90 is formed separately from the drawer 62 and then joined to the drawer 60 during final assembly. It will be appreciated that in other embodiments the bracket 90 and the drawer 62 may be made integral in a single injection mold.

The mounting bracket 90 is configured to be separately secured to a plurality of interchangeable utility modules 100 that are sized to be positioned within the storage chamber 82. The term "interchangeable utility module" is defined herein as a bin, tray, container, cartridge, or other structure sized to be positioned within a drawer of a domestic refrigerator and suitable for organizing, storing, or preserving food items. Examples of interchangeable utility modules include a storage bin sized to receive long stem produce or a container having a number of wire baskets sized to receive small and delicate food items such as mushrooms, tomatoes, garlic, cherry tomatoes, etcetera. Other interchangeable utility modules may include food preservation agents or odor removing agents. In the embodiments shown in FIGS. 2-9, the plurality of interchangeable utility modules 100 are formed by injection molding polypropylene. In some embodiments of the interchangeable utility modules 100 shown in FIGS. 2-9, the polypropylene is opaque or colored and in other embodiments the polypropylene is clear. It should be appreciated that in other embodiments the interchangeable utility modules 100 may be formed from other plastic materials.

Each of the interchangeable utility modules 100 includes a mounting bracket 102 sized and configured to be separately mated with the mounting bracket 90 of the drawer 62. For example, the mounting bracket 102 of each of the interchangeable utility modules 100 illustrated in FIGS. 2-9 includes a pair of hooks or slots 110 (see FIG. 3). As shown in FIG. 2, the mounting bracket 90 of the drawer 62 is embodied as the mounting arms 92. Each of the mounting arms 92 includes a base plate 112 that is secured to one of the sidewalls 68. A post 114 extends outwardly from the base plate 112 and includes a knob 116 formed at an end 118. The slots 110 of the interchangeable utility module 100 receive the knobs 116 such that the interchangeable utility module 100 is separately secured to the drawer 62, as shown in FIG. 4.

It will be appreciated that in other embodiments the structure of the mounting brackets 90, 102 may be reversed such that the mounting bracket 90 includes the pair of slots and the mounting bracket 102 includes the mounting arms. Additionally, in other embodiments, the mounting brackets 90, 102 may take the form of hooks, pins, latches, or other any other structure capable of be mated together to secure and support each of the interchangeable utility modules 100.

Figure 3:
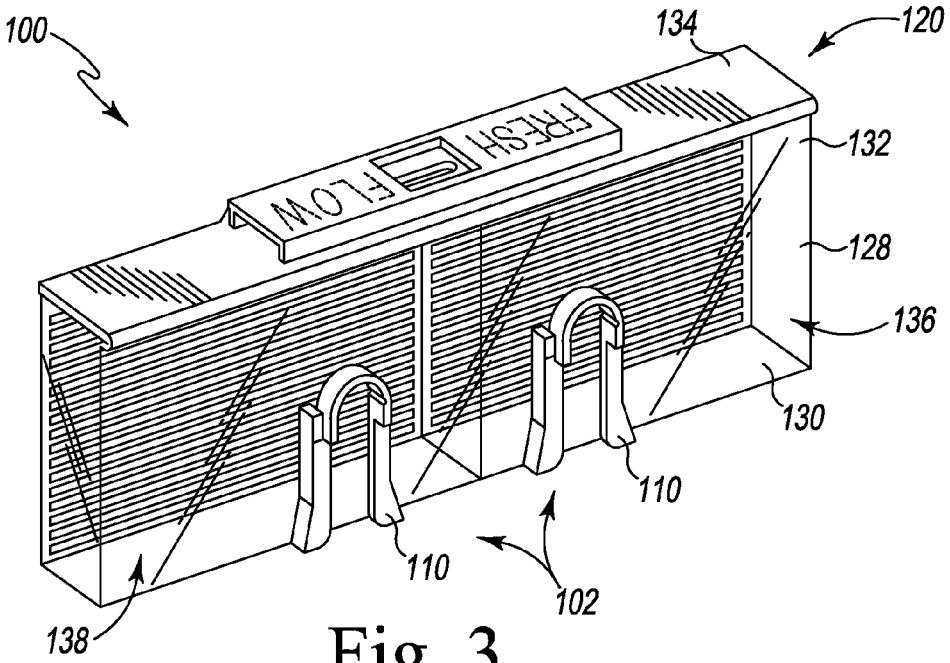
FIG. 3 is a rear perspective view of the embodiment of the interchangeable utility module of FIG. 2.
Figure 4:
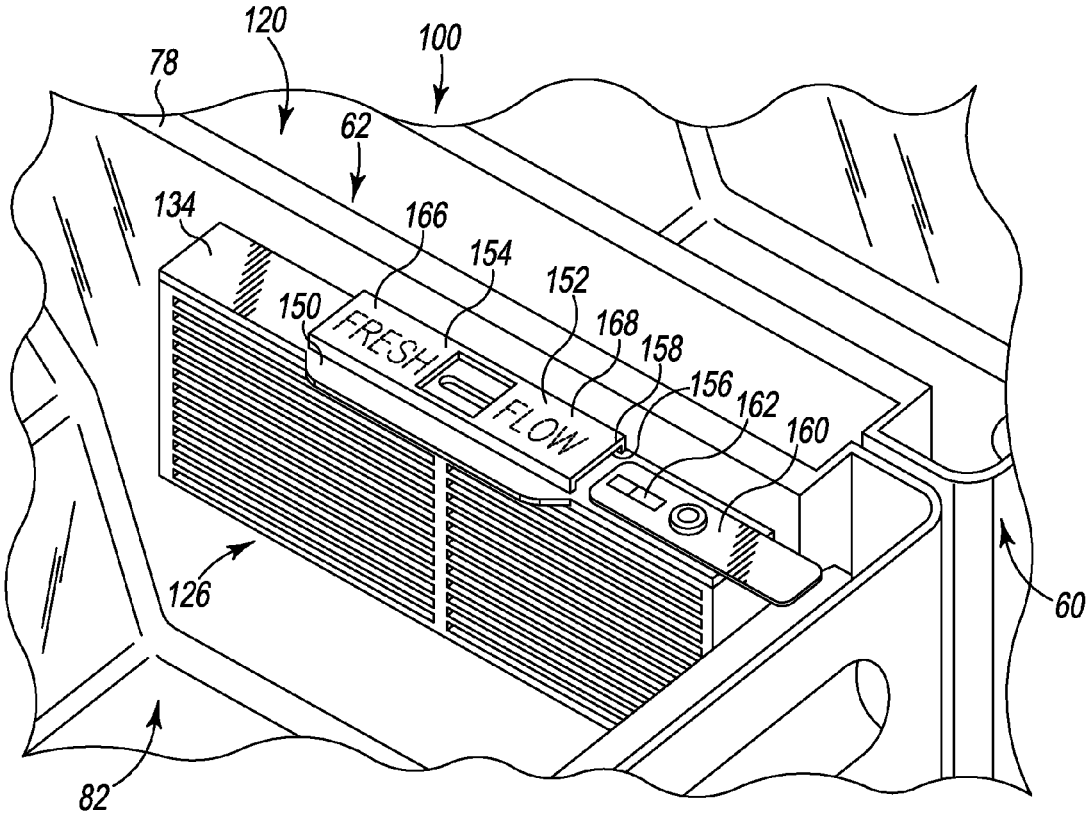
FIG. 4 is a fragmentary perspective view of the embodiment of the interchangeable utility module of FIG. 2 showing one embodiment of a removable elapsed time indicator.

Referring now to FIGS. 2-4, one embodiment of an interchangeable utility module 100 is shown as a food preservation cartridge 120. The cartridge 120 has a housing 126 that receives a pair of sachets 122, 124. Each of the sachets 122, 124 contains an ethylene absorbing agent to eliminate ethylene generated by food items stored in the drawer 62. One example of an ethylene absorbing agent is described in U.S. Pat. No. 5,278,112 entitled "CHEMICALLY IMPREGNATED ZEOLITE AND METHOD FOR CHEMICALLY IMPREGNATING AND COATING ZEOLITE," which is incorporated in its entirety herein by reference.

The housing 126 of the cartridge 120 has a number of sidewalls 128 extending upwardly from a bottom wall 130 to an upper end 132. A cover 134 is hinged to the upper end 132 of the housing 126. The sidewalls 128 define a pair of rectangular compartments 136, 138, each of which is sized to receive one of the sachets 122, 124. An open top side 140 of the housing 126 defines access openings 142, 144, which provide user access to the sachets 122, 124 when the cover 134 is open. When the cover 134 is closed, the access openings 142, 144 are sealed, thereby preventing the user from accessing the compartments 136, 138 and the sachets 122, 124 positioned therein.

One of the sidewalls 128 includes a plurality of vent openings 146 that permit air to pass into and out of the compartments 136, 138. In that way, ethylene generated within the drawer 62 advances into the compartments 136, 138. Within the compartments 136, 138, ethylene reacts with the ethylene absorbing agents contained in the sachets 122, 124, thereby helping to preserve food items stored in the drawer 62. It will be appreciated that in other embodiments other sidewalls 128 and/or the bottom wall 130 of the housing 126 may include vent openings that permit air to pass into and out of the compartments 136, 138.

The cover 134 of the cartridge 120 includes an outwardly extending flange 150 that may be used to open the cover 134. As shown in FIGS. 3 and 4, the cover 134 also includes a plate 152 extending upwardly to a top surface 154. The plate 152 has a slot 156 defined in an end 158. The slot 156 is sized to receive an elapsed time indicator 160, which provides an indication of how long the sachets 122, 124 have been in use. When the sachets 122, 124 are replaced, a new indicator 160 is placed in the slot 156. The indicator 160 includes a status bar 162 that displays the amount of time elapsed since the sachets 122, 124 were placed in the cartridge 120. When the indicator 160 is properly positioned in the slot 156, the status bar 162 is visible through an aperture 164 formed in the top surface 154 of the plate 152. One example of an elapsed time indicator is the Timestrip®, which is commercially available from Timestrip Plc. of England, U.K.

The top surface 154 of the plate 152 also includes label zones 166, 168 that inform the user of which interchangeable utility module is currently in use. As shown in FIGS. 3 and 4, the food preservation cartridge 120 has the text "FRESH FLOW" formed in the label zones 166, 168, indicating that the current interchangeable utility module 100 is the food preservation cartridge 120. Other interchangeable utility modules 100 may include similar markings to indicate which interchangeable utility module is currently in use. It will also be appreciated that in other embodiments graphics or other images may be used in the place of text to inform the user of which interchangeable utility module is currently in use. Additionally, in other embodiments, the interchangeable utility modules 100 may be unmarked.

Referring now to FIGS. 5-9, other embodiments of interchangeable utility modules 100 are illustrated. Some features of the embodiments illustrated in FIGS. 5-9 are substantially similar to those discussed above in reference to the embodiment of FIGS. 1-4. Such features are designated in FIGS. 5-9 with the same reference numbers as those used in FIGS. 1-4.

Figure 5:
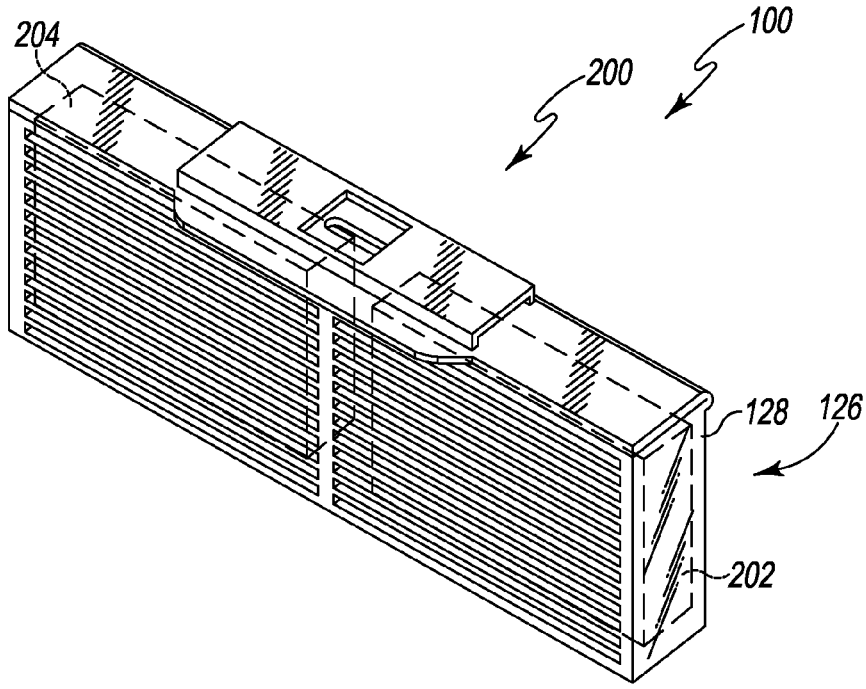
FIG. 5 is a perspective view of another embodiment of an interchangeable utility module of the domestic refrigerator of FIG. 1.

Referring now to FIG. 5, the interchangeable utility module 100 is embodied as an odor removing cartridge 200. Similar to the cartridge 120, the cartridge 200 includes a housing 126 that receives a pair of sachets 202, 204. Each of the sachets 202, 204 contains an odor absorbing agent. One example of an odor absorbing agent is sodium bicarbonate, which is also known as baking soda. As discussed above, one of the sidewalls 128 of the housing 126 includes a plurality of vent openings 146 that permit air to pass into and out of the housing 126. Odor-carrying particles generated within the drawer 62 advance into the housing 126. Within the housing 126, the odor-carrying particles react with the odor absorbing agents contained in the sachets 202, 204, thereby helping to eliminate odors in the drawer 62.

Figure 6:
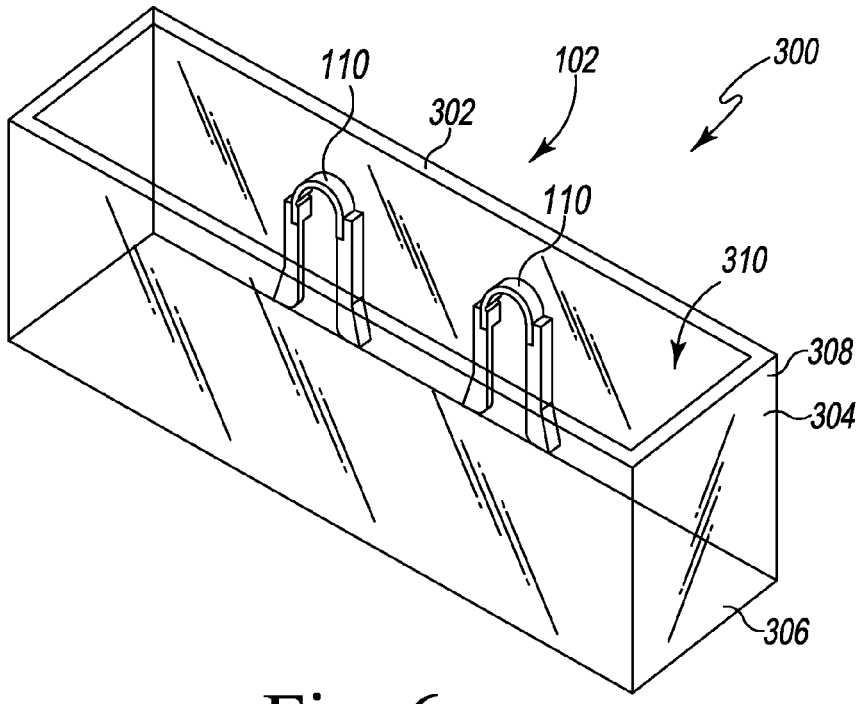
FIG. 6 is a perspective view of another embodiment of an interchangeable utility module of the domestic refrigerator of FIG. 1.

Referring now to FIG. 6, another embodiment of the interchangeable utility module 100 is shown as a food storage container 300. The container 300 includes a housing 302 formed from clear polypropylene. The housing 302 has a number of sidewalls 304 extending upwardly from a bottom wall 306 to an upper end 308. One of the sidewalls 304 includes the mounting bracket 102 that receives the mounting bracket 90 of the drawer 62.

The sidewalls 304 define a rectangular bin 310 sized to receive long stem produce such as, for example, celery, carrots, asparagus, leeks, and so forth. In other embodiments, the container 300 may include a cover hinged to the upper end 308 of the housing 302. Additionally, in other embodiments, the container 300 may include a tray or basket to hold the produce above the bottom wall 306.

Figure 7:
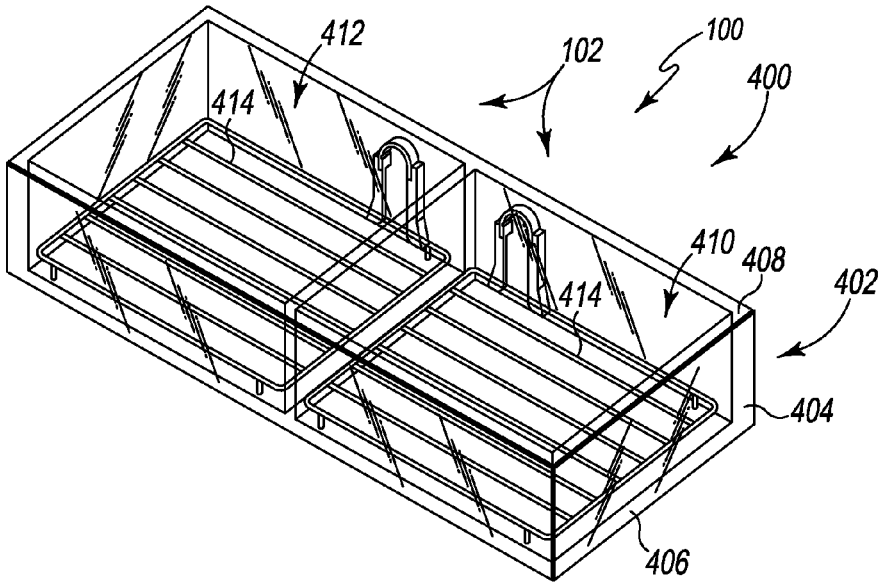
FIG. 7 is a perspective view of another embodiment of an interchangeable utility module of the domestic refrigerator of FIG. 1.

Referring now to FIG. 7, another embodiment of the interchangeable utility module 100 is shown as a small items storage container 400. The container 400 includes a housing 402 formed from clear polypropylene. The housing 402 has a number of sidewalls 404 extending upwardly from a bottom wall 406 to an upper end 408. One of the sidewalls 404 includes the mounting bracket 102 that receives the mounting bracket 90 of the drawer 62.

The sidewalls 404 define a pair of bins 410, 412 sized to receive small and/or delicate food items, such as, for example, mushrooms, tomatoes, garlic, grapes, and so forth. Each of the bins 410, 412 includes a metal wire basket or tray 414, which maintains the food items above the bottom wall 406. It will be appreciated that in other embodiments the tray 414 may be formed from plastic or rubber. Additionally, in other embodiments, the container 400 may include a cover hinged to the upper end 408 of the housing 402.

Figure 8:
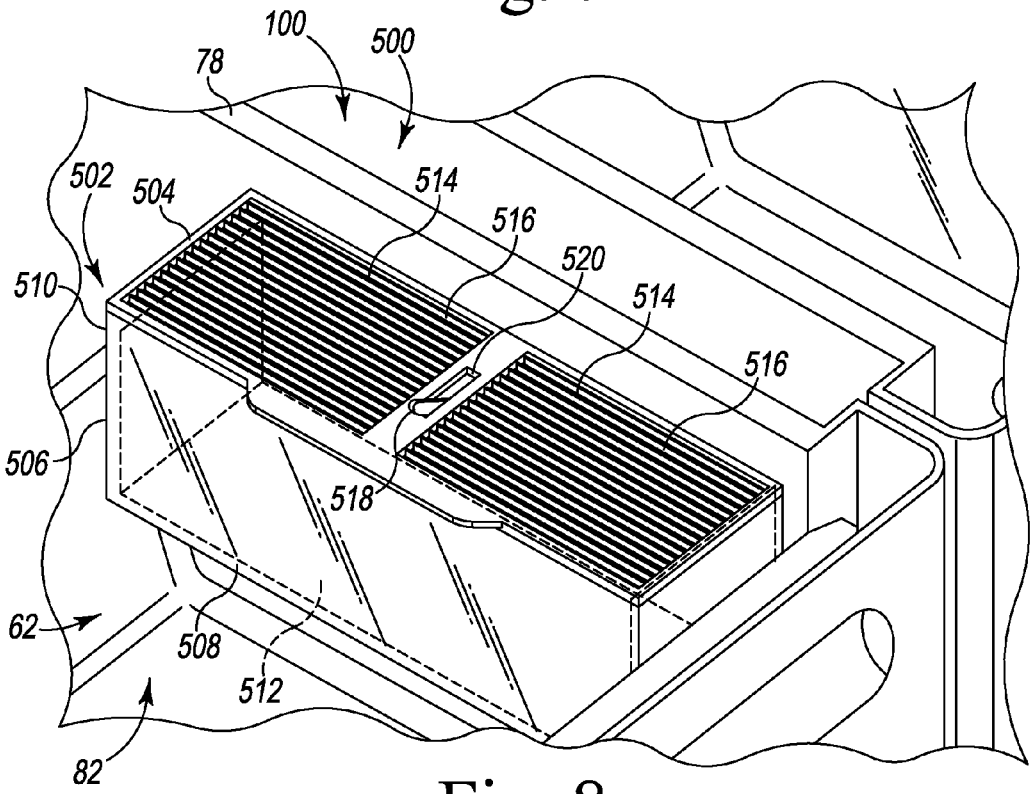
FIG. 8 is a perspective view of another embodiment of an interchangeable utility module of the domestic refrigerator of FIG. 1.

Referring now to FIG. 8, another embodiment of the interchangeable utility module 100 is shown as a humidity controlled cartridge 500 positioned within the drawer 62. The cartridge 500 includes a housing 502 having a hinged cover 504. The housing 502 has a number of sidewalls 506 extending upwardly from a bottom wall 508 to an upper end 510. The sidewalls 506 define a rectangular compartment 512 into which a user may place food items that should be maintained at various humidity levels, such as, for example, some types of herbs and lettuce. When the cover 504 is open, user access to the compartment 512 is permitted.

The cover 504 includes a plurality of louvered openings 514 that permit air to pass into and out of the compartment 512. Each of the louvered openings 514 has a movable fin or slat 516. The angle of each slat 516, and, consequently, the size of each opening 514, is controlled by lever 518 extending outwardly from the cover 504 through a slot 520. When the lever 518 is repositioned in the slot 520, the angle of the each slat 516 changes by a corresponding degree. When the lever 518 is positioned at one end of the slot 520, each slat 516 is angled such that the maximum amount of air is permitted to pass into and out of the compartment 512 through each opening 514. When the lever 518 is positioned at the opposite end of the slot 520, each slat 516 is angled such that each opening 514 is closed. In that way, the louvered openings 514 are operable to regulate air flow into the compartment 512 and thereby control the humidity level within the compartment 512.

Figure 9:
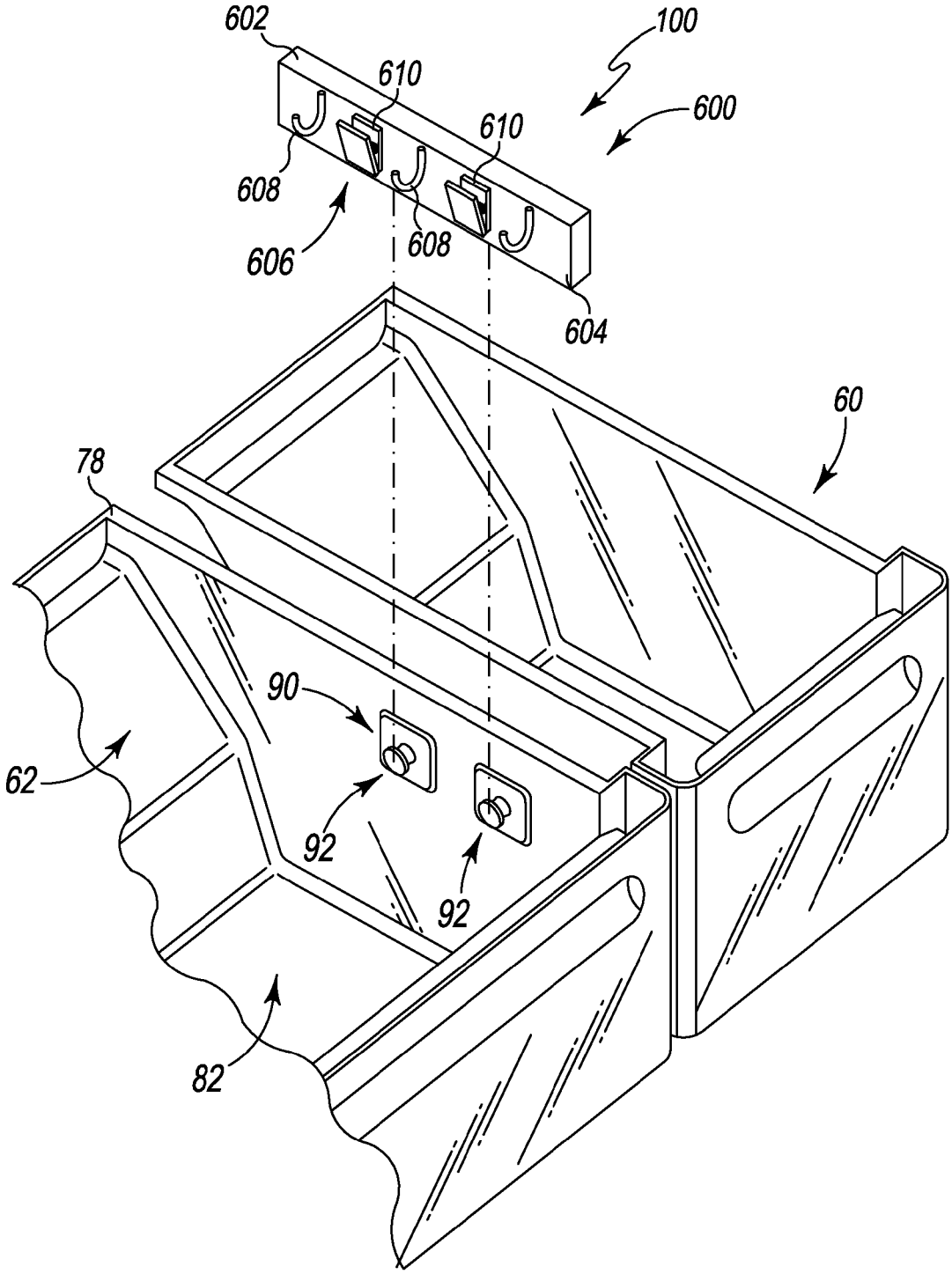
FIG. 9 is a perspective view of another embodiment of an interchangeable utility module of the domestic refrigerator of FIG. 1.

Referring now to FIG. 9, another embodiment of the interchangeable utility module 100 is shown as a hanging rack bar 600. The bar 600 includes a rectangular beam 602 having a front surface 604 facing the storage chamber 82 of the drawer 62 and a rear surface (not shown) positioned opposite the front surface 604. Like the other interchangeable utility modules 100, the beam 602 includes the mounting bracket 102, which is defined in the rear surface of the beam 602 and therefore not visible in FIG. 9.

The front surface 604 has a plurality of mounting elements 606 secured thereto. Each of the mounting elements 606 is configured to allow the user to hang plastic bags or other pre-packaged food items. As shown in FIG. 9, the mounting elements 606 include a number of mounting hooks 608 and a number of spring-loaded retaining clips 610.

As will be appreciated by those of the skill in the art, the refrigerator 10 may include elements other than those shown and described above. In another embodiment, the drawer 62 may include an additional mounting bracket 90 such that two or more interchangeable utility modules 100 may be positioned in the storage chamber 82 concurrently. Similarly, the drawer 60 may include a mounting bracket in addition to, or in place of, the mounting bracket 90. It should also be appreciated that the location of mounting bracket 90 may also be altered. It will be also appreciated that in other embodiments the utility modules 100 may be used in the freezer compartment 32. In those embodiments, the freezer compartment 32 may include sidewalls, shelves, or storage bins including a mounting bracket sized and configured to separately receive the mounting bracket of each of the utility modules 100.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A domestic refrigerator comprising:

a housing having a refrigerated compartment defined therein, a sliding drawer positioned in the refrigerated compartment, the sliding drawer having a number of sidewalls that define a storage chamber and a pair of mounting arms integrally formed with one sidewall and extending therefrom into the storage chamber, and a plurality of interchangeable utility modules sized to be positioned within the storage chamber of the sliding drawer and configured to be separately mated with the pair of mounting arms, wherein the plurality of interchangeable utility modules include:

a first interchangeable utility module positioned in the storage chamber, the first interchangeable utility module comprising (i) a pair of slots mated with the mounting arms of the sliding drawer, (ii) a housing having a vented compartment defined therein, the vented compartment being sized to receive a sachet containing an ethylene absorbing agent, (iii) a cover hinged to an upper end of the housing, the cover being moveable between an open position in which user access to the vented compartment is permitted and a closed position in which user access to the vented compartment is prevented, and (iv) a removable elapsed time indicator secured to the cover and configured to provide an indication of the ethylene absorbing agent, and a second interchangeable utility module comprising (i) a pair of slots configured to be separately mated with the mounting arms of the sliding drawer in place of the first interchangeable utility module such that only the second interchangeable utility module is mated with the mounting arms, and (ii) a housing having a compartment defined therein and a cover hinged to an upper end of the housing.

2. The domestic refrigerator of claim 1, wherein the plurality of interchangeable utility modules further include a third interchangeable utility module comprising (i) a pair of slots configured to be separately mated with the mounting arms of the sliding drawer in place of the first interchangeable utility module and the second interchangeable utility module such that only the third interchangeable utility module is mated with the mounting arms, and (ii) an uncovered housing having a rectangular compartment defined therein, the rectangular compartment being sized to receive a food item.

3. The domestic refrigerator of claim 1, wherein the housing of the first interchangeable utility module has a second vented compartment defined therein, the second vented compartment being sized to receive a second sachet containing an ethylene absorbing agent.

4. The domestic refrigerator of claim 2, wherein the plurality of interchangeable utility modules include a fourth interchangeable utility module comprising a pair of slots configured to be separately mated with the mounting arms of the sliding drawer in place of the first interchangeable utility module, the second interchangeable utility module, and the third interchangeable utility module such that only the fourth interchangeable utility module is mated with the mounting arms, the fourth interchangeable utility module further comprising:

a housing having a vented compartment defined therein, the vented compartment being sized to receive a sachet containing an odor absorbing agent, and a cover hinged to an upper end of the housing, the cover being movable between (i) an open position in which user access to the vented compartment is permitted, and (ii) a closed position in which user access to the vented compartment is prevented.

5. The domestic refrigerator of claim 1, wherein the plurality of interchangeable utility modules include a third interchangeable utility module comprising a pair of slots configured to be separately mated with the mounting arms of the sliding drawer in place of the first interchangeable utility module and the second interchangeable utility module such that only the third interchangeable utility module is mated with the mounting arms, the third interchangeable utility module further comprising:

a housing having a first compartment and a second compartment defined therein, a first storage tray positioned in the first compartment and sized to receive a first food item, and a second storage tray positioned in the second compartment and sized to receive a second food item.

6. The domestic refrigerator of claim 1, wherein the plurality of interchangeable utility modules include a third interchangeable utility module comprising a pair of slots configured to be separately mated with the mounting arms of the sliding drawer in place of the first interchangeable utility module and the second interchangeable utility module such that only the third interchangeable utility module is mated with the mounting arms, the third interchangeable utility module further comprising:

a housing having a compartment defined therein, the compartment being sized to receive a food item, a cover hinged to an upper end of the housing, the cover being movable between (i) an open position in which user access to the compartment is permitted, and (ii) a closed position in which user access to the compartment is prevented, and a number of louvered vents extending through the cover, each of the number of louvered vents being operable to regulate air flow into the compartment.

7. The domestic refrigerator of claim 6, wherein the plurality of interchangeable utility modules include a fourth interchangeable utility module comprising a pair of slots configured to be separately mated with the mounting arms of the sliding drawer in place of the first interchangeable utility module, the second interchangeable utility module, and the third interchangeable utility module such that only the fourth interchangeable utility module is mated with the mounting arms, the fourth interchangeable utility module further comprising:

a rectangular beam, the beam having a rear surface and a front surface positioned opposite the rear surface, the rear surface having the pair of slots defined therein, and a plurality of mounting elements positioned on the front surface of the rectangular beam.

8. The domestic refrigerator of claim 7, wherein the plurality of mounting elements include a number of hooks and a number of retaining clips.

9. A crisper drawer for a domestic refrigerator, comprising:

a number of sidewalls defining a storage chamber, a mounting bracket integrally formed with one of the sidewalls and extending therefrom into the storage chamber, a first interchangeable utility module configured to be positioned within the storage chamber, the first interchangeable utility module including (i) a pair of sachets, each sachet containing an absorptive agent, and (ii) a mounting bracket sized and configured to be separately mated with the mounting bracket extending from one of the sidewalls such that only the first interchangeable utility module is secured to the mounting bracket, and a second interchangeable utility module positioned within the storage chamber, the second interchangeable utility module including (i) a compartment sized to receive a food item, (ii) a louvered vent including a lever operable to regulate humidity in the compartment, the lever being moveable between a first position in which the louvered vent is closed and a second position in which the louvered vent is open, and (iii) a mounting bracket mated with the mounting bracket extending from one of the sidewalls such that only the second interchangeable utility module is secured to the mounting bracket.

10. The crisper drawer of claim 9, wherein the absorptive agent is an odor absorbing agent.

11. The crisper drawer of claim 9, wherein the absorptive agent is an ethylene absorbing agent.

12. The crisper drawer of claim 9, wherein the mounting bracket extending from one of the sidewalls includes a pair of mounting arms, the mounting bracket of each of the first interchangeable utility module and the second interchangeable utility module includes a pair of slots sized to receive the pair of mounting arms.

13. A domestic refrigerator comprising:

a housing having a refrigerated compartment defined therein, a sliding drawer positioned in the refrigerated compartment, the sliding drawer having a storage chamber defined therein and a mounting bracket extending into the storage chamber, the mounting bracket including a base plate secured to a side wall of the sliding drawer and a knob spaced apart from the base plate, and a plurality of interchangeable utility modules configured to be positioned within the storage chamber of the sliding drawer, wherein each of the plurality of the interchangeable utility modules includes a mounting bracket comprising a slot sized to receive the knob and configured to be separately mated with the mounting bracket of the sliding drawer, wherein the plurality of interchangeable utility modules include:

a first interchangeable utility module including (i) a housing having the slot defined therein, the slot receiving the knob such that the first interchangeable utility module is mated with the mounting bracket of the sliding drawer, (ii) a sachet positioned in a compartment defined in the housing, the sachet containing an ethylene absorbing agent, (iii) a cover hinged to an upper end of the housing, and (iv) a removable elapsed time indicator secured to the cover and configured to provide an indication of the ethylene absorbing agent, and a second interchangeable utility module different from the first interchangeable utility module and configured to be separately mated with the mounting bracket of the sliding drawer in place of the first interchangeable utility module, the second interchangeable utility module being selected from the group consisting of: (i) a housing having a vented compartment defined therein sized to receive a food item, and (ii) a rectangular beam having a plurality of mounting elements positioned on a front surface thereof.

* * * * *